US010994816B2

(12) United States Patent
Roth

(10) Patent No.: US 10,994,816 B2
(45) Date of Patent: May 4, 2021

(54) FLOATING DEVICE HAVING ACTIVE STABILIZATION AND METHOD FOR ACTIVE STABILIZATION

(71) Applicant: SPAWAR Systems Center Pacific, San Diego, CA (US)

(72) Inventor: Leif E. Roth, San Diego, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 151 days.

(21) Appl. No.: 16/292,132

(22) Filed: Mar. 4, 2019

(65) Prior Publication Data

US 2020/0283105 A1 Sep. 10, 2020

(51) Int. Cl.
*B63B 39/04* (2006.01)
*B63B 39/14* (2006.01)

(52) U.S. Cl.
CPC ..... *B63B 39/04* (2013.01); *B63B 39/14* (2013.01)

(58) Field of Classification Search
CPC ..... B63B 39/04; B64G 1/286
See application file for complete search history.

(56) References Cited

U.S. PATENT DOCUMENTS

| | | | | |
|---|---|---|---|---|
| 5,628,267 | A * | 5/1997 | Hoshio | B63B 39/04 114/122 |
| 5,632,222 | A * | 5/1997 | Fido | B63B 39/04 114/330 |
| 6,973,847 | B2 | 12/2005 | Adams et al. | |
| 7,240,630 | B2 | 7/2007 | Akers | |
| 2007/0162217 | A1 | 7/2007 | Selbe | |
| 2008/0167768 | A1 | 7/2008 | Rubenstein et al. | |
| 2011/0094433 | A1 * | 4/2011 | Shoda | B63C 11/42 114/330 |
| 2014/0017083 | A1 | 1/2014 | Amo | |

* cited by examiner

*Primary Examiner* — Andrew Polay
(74) *Attorney, Agent, or Firm* — Naval Information Warfare Center, Pacific; Kyle Eppele; Matthew D. Pangallo

(57) ABSTRACT

A floating device having active stabilization and a method for actively stabilizing a floating device employs a floating device that operates underwater and which may be tethered to the floor of the body of water. The floating device having active stabilization includes an internal sensor assembly which measures angular velocity and generates a real time output corresponding to a measured angular velocity and a counter-rotation assembly which generates in real time mechanical energy in the form of rotation in response to the real time output of the sensor assembly that causes a counter-rotation torque on the device body that opposes the measured angular velocity. The counter-rotation torque may be imparted by accelerating a flywheel as a reaction wheel in the opposite direction of the desired counter-rotation torque, thereby achieving stability of the device body in the form of minimizing rotation.

17 Claims, 3 Drawing Sheets

FLOATING DEVICE HAVING ACTIVE STABILIZATION AND METHOD FOR ACTIVE STABILIZATION

STATEMENT OF GOVERNMENT INTEREST

FEDERALLY SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif. 92152; telephone (619) 553-5118; email: ssc_pac_t2@navy.mil. Reference Navy Case No. 103713.

BACKGROUND OF THE INVENTION

Field of the Invention

This disclosure relates generally to a floating device having an internal, active stabilization system and method.

Description of the Prior Art

The use and design of tethered and free-floating flotation devices in an underwater environment for various underwater operations is well established. Because of the nature of underwater environments, such as the forces created by the motion of the water, measures to stabilize such floating devices must typically be taken to allow the floating devices to be utilized for many desirable functions. Along these lines, thrusters are commonly used to actively control and stabilize underwater bodies while deployed underwater. But because thrusters generally require external moving parts that are exposed to the elements in the underwater environment, such thrusters can be susceptible to being damaged or biofouled. As a result, the thrusters may fail. As such, a problem which still exists is that floating devices when deployed in an underwater environment may be rendered unusable or require maintenance due to failures in their stabilization mechanisms while their internal components still have a substantial lifespan remaining.

Thus, there remains a need for an active stabilization mechanism and method for a flotation device that is shielded from premature degradation due to exposure to a harsh underwater environment.

SUMMARY OF THE INVENTION

The present disclosure describes a floating device having active stabilization, comprising a device body, wherein said device body is buoyant and constructed to be positioned underwater; a sensor assembly disposed in the device body, wherein the sensor assembly is adapted to measure angular velocity and generate a real time output corresponding to a measured angular velocity; and a counter-rotation assembly disposed in the device body integral with said sensor assembly, wherein said counter-rotation assembly is adapted to generate in real time mechanical energy in a form of rotation in response to the real time output of the sensor assembly that causes a counter-rotation torque on the device body that opposes the measured angular velocity.

DETAILED DESCRIPTION OF THE INVENTION

Described herein is a floating device having active stabilization that operates underwater in an upright orientation in a body of water. The floating device may be tethered to the floor of the body of water. The floating device having active stabilization uses feedback from a rotation sensing mechanism to calculate a desired torque to minimize rotation. The floating device imparts the desired torque on itself by accelerating a flywheel as a reaction wheel in the opposite direction of the desired torque. In this manner, the floating device achieves stability with minimal rotation using a feedback loop between the rotation sensing mechanism and the flywheel.

Figure 1:
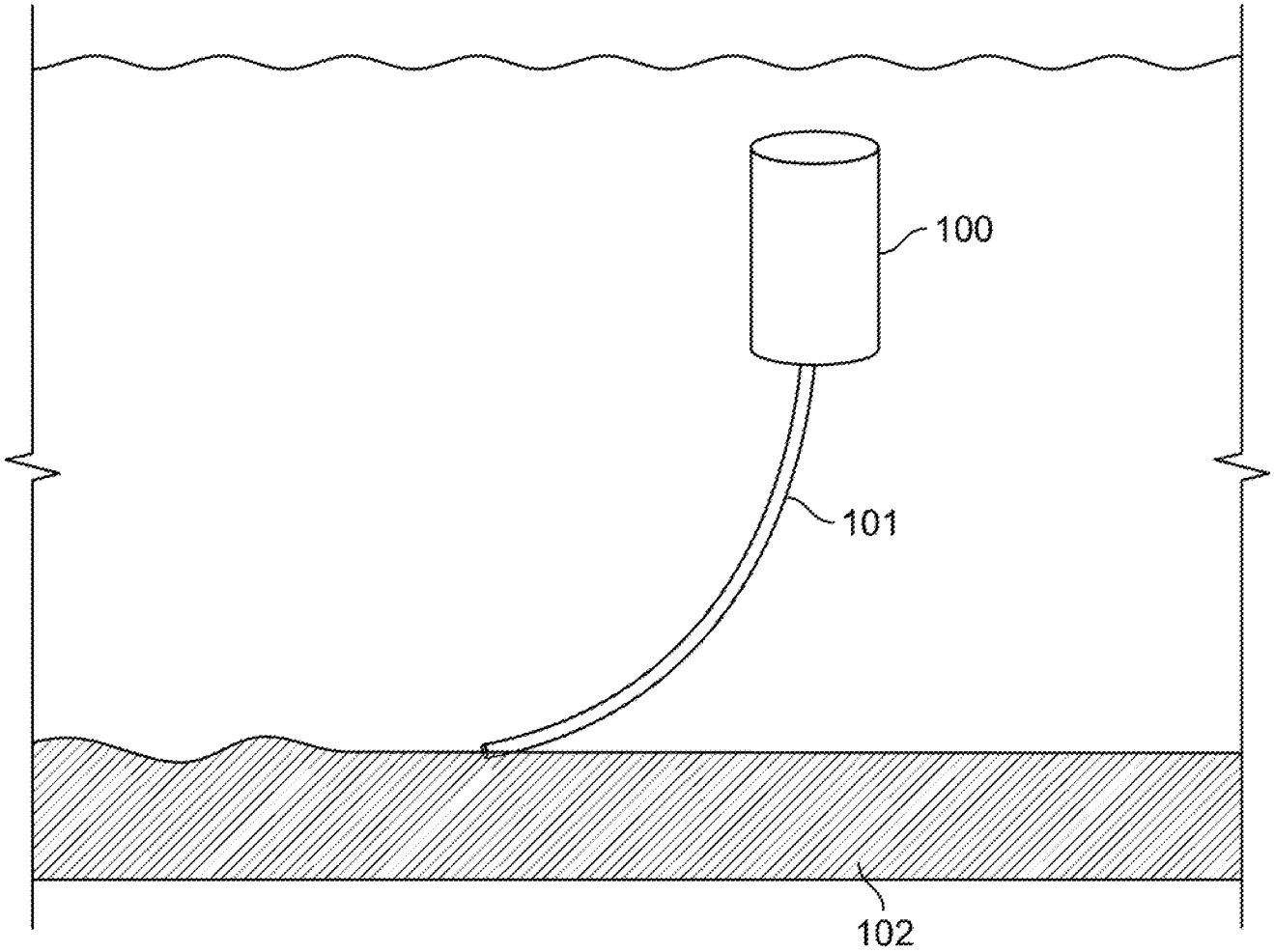
FIG. 1 is a side elevational view of a floating device having active stabilization built in accordance with the present disclosure in an underwater environment and tethered to the sea floor.
Figure 2:
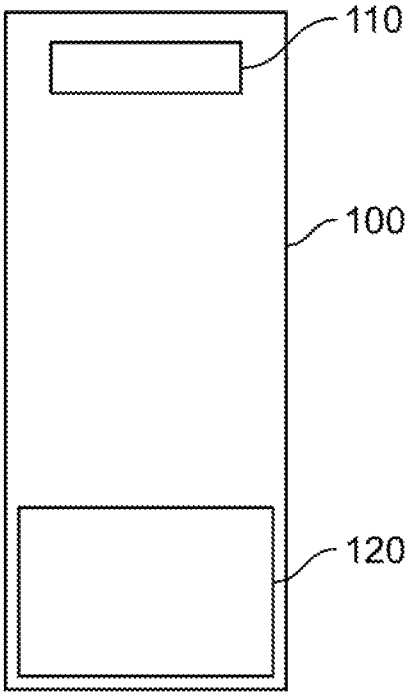
FIG. 2 a side elevational view of a cross section of a floating device having active stabilization built in accordance with the present disclosure.
Figure 3:
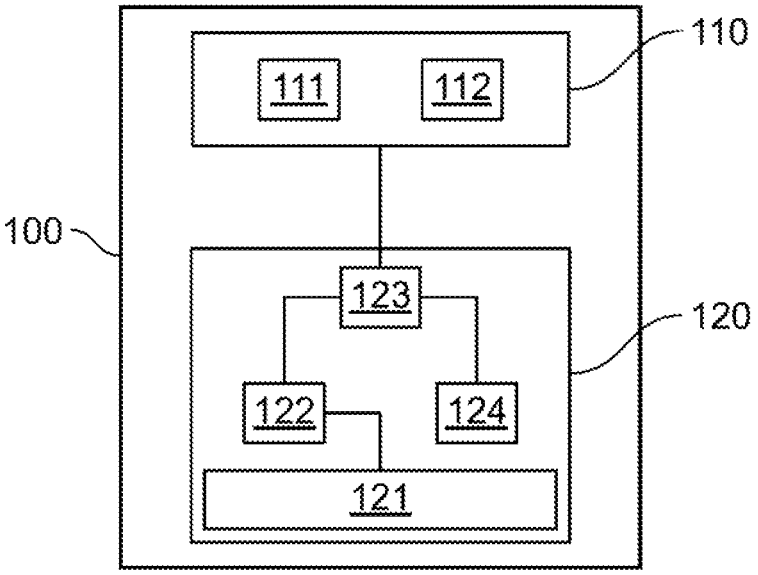
FIG. 3 is a schematic view of a floating device having active stabilization built in accordance with the present disclosure.

Referring now to the drawings, and in particular, FIGS. 1, 2 and 3, Applicant's floating device having active stabilization is shown having a device body 100 that is buoyant and constructed to be positioned underwater. The device body 100 may be defined by a cylindrical housing having an upper end and a lower end.

The device body 100 includes a sensor assembly 110 and a counter-rotation assembly 120 disposed therein, and may additionally be attached to one end of an elongated tether 101, with the elongated tether 101 also attached to an attachment object 102, such as a floor of a body of water in which the device body 100 is disposed (or other fixed or movable object in or around such a body of water). Thus, the device body 100 may be fixed to the attachment object with the elongated tether 101.

The sensor assembly 110 may include a gyroscope 111 or other device operative to measure angular (or rotational) velocity. The sensor assembly 110 may also include a compass 112 which may replace or supplement the device operative to measure angular velocity. By being positioned inside the device body 100, the sensor assembly 110 is operative to measure rotation of the device body 100 and generate an output of electrical signals which may provide a real time indication of the direction and speed of any rotation of the device body 100.

The counter-rotation assembly 120 may include a flywheel 121, a motor 122, a controller 123 and a battery 124 or other source of electrical power. The motor 122, controller 123 and battery 124 are electrically interconnected such that the controller 123 can cause electricity from the battery 124 to be supplied to the motor 122 so as to cause the motor 122 to generate mechanical energy. It is contemplated that the motor 122 in accordance with the present disclosure may generate mechanical energy in a form of rotation and that the controller 123 may be operative to vary the voltage or current of the electrical power supplied to the motor 122 to control the motor's 122 rotational acceleration and to selectively invert the polarity of the voltage applied to the motor 122 to control the motor's 122 rotation direction.

The motor 122 and the flywheel 121 are mechanically connected such that the rotation of the motor 122 causes the flywheel 121 to rotate in the same direction as the motor 122 and at a speed that correlates to the rotation speed of motor 122. In this regard, the controller 123 is operative to cause the flywheel 121 to rotate in a desired direction and at a desired speed.

The controller 123 may be connected to the sensor assembly 110 so as to receive as electrical signals the output of the sensor assembly 110 in real time. The controller 123 may include or be able to access software containing instructions which allow it to determine a desired rotational acceleration and direction for the flywheel 121 to minimize axial rotation of the device body 100. It is contemplated that the controller 123 makes this determination based on the real time indication of the direction and speed of any rotation of the device body 100 in the output of the sensor assembly 110. In this regard, in seeking to minimize axial rotation, the controller 123 operates when the controller 123 determines that the device body 100 requires torque applied in a first direction at a first magnitude in order to resist axial rotation being caused by an external force (like a water current). When such a determination is made, the controller 123 can cause the flywheel 121 to accelerate in the opposite direction of the first direction with an acceleration proportional to the desired magnitude of torque. The resultant rotation of the flywheel 121 causes the device body 100 to experience a torque proportionately in the first direction at the first magnitude through the conservation of angular momentum.

Figure 4:
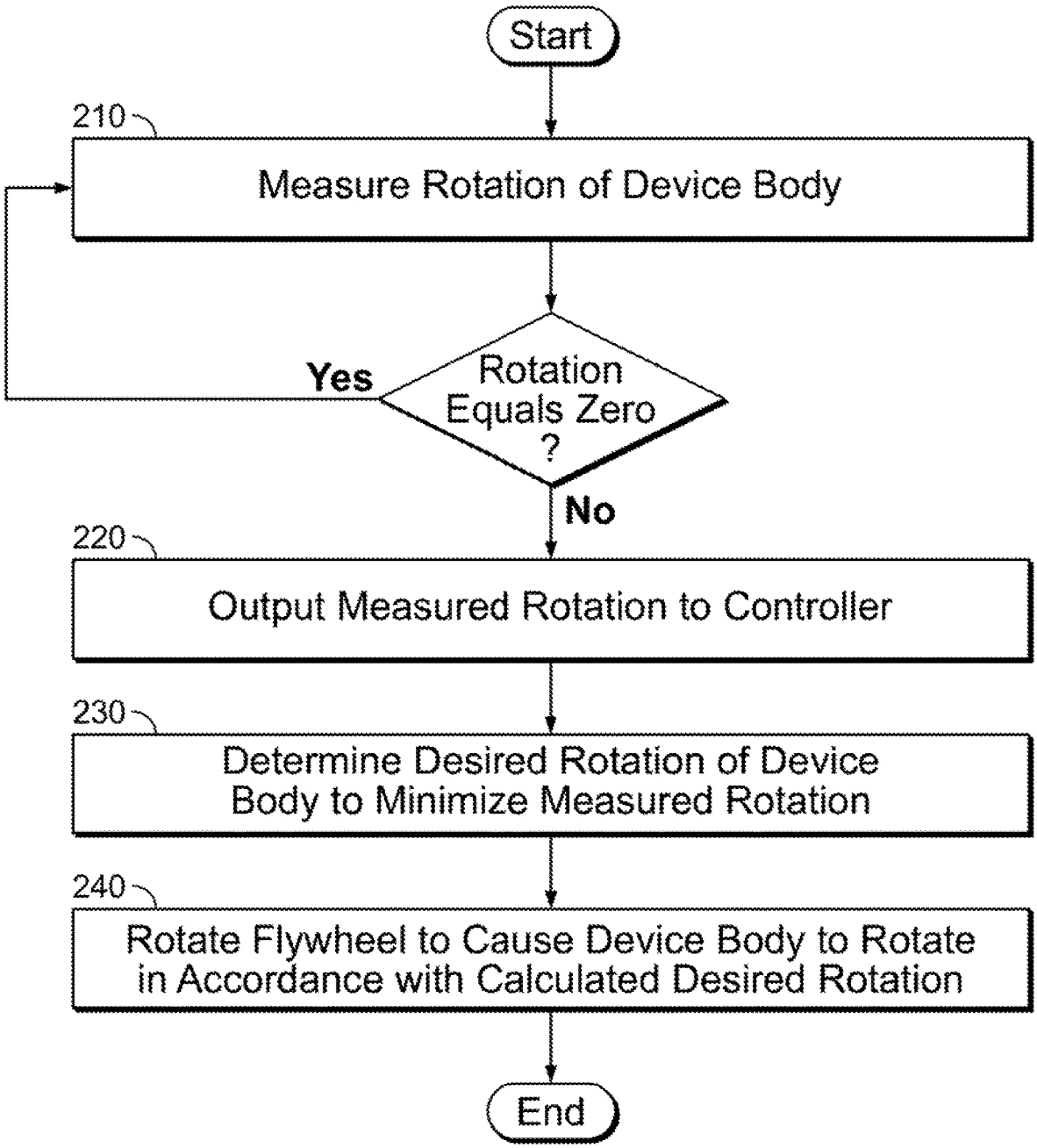
FIG. 4 shows the process by which a floating device having active stabilization minimizes rotation in accordance with the present disclosure.

Referring now to FIG. 4, an active stabilization process for a floating device in accordance with the present disclosure begins, at step 210, with measuring rotation of a device body using a sensor assembly. If the measured rotation of the device body equals zero, no action is taken and the measuring step continues. But if rotation of the device body is found or detected, the measured rotation is provided as an output to a controller at step 220. The controller then determines in real time a desired torque direction and magnitude for the device body to counteract the measured rotation of the device body and minimize the rotation of the device body at step 230. The controller then causes a flywheel to accelerate in the direction opposite the desired torque direction for the device body at an acceleration that is proportional to the desired torque for the device body at step 240. This acceleration by the flywheel causes the device body to decelerate proportionately to the speed of the device body through the conservation of angular momentum.

It is contemplated that the controller 123 may be embodied as a single microcontroller or several computer hardware components.

It is appreciated that the floating device having active stabilization in accordance with the present disclosure exposes no moving parts to the environment outside of the device body 100 so it may be unaffected by biofouling, corrosion, and other damage. Advantageously, this may significantly increase the longevity of the floating device having active stabilization in a harsh underwater environment.

It is contemplated that the device body 100 of the floating device having active stabilization in accordance with the present disclosure may alternatively be free floating or tethered to a floating body (as opposed to just tethered to a sea floor).

It will be understood that many additional changes in the details, materials, steps and arrangement of parts, which have been herein described and illustrated to explain the nature of the disclosure, may be made by those skilled in the art within the principle and scope of the invention as expressed in the appended claims.

What is claimed is:

1. A floating device having active stabilization, comprising:

a device body, wherein said device body is buoyant and constructed to be positioned underwater;

a sensor assembly disposed in the device body, wherein the sensor assembly includes a gyroscope, a compass, is adapted to measure angular velocity, and generates a real time output corresponding to a measured angular velocity; and a counter-rotation assembly disposed in the device body integral with said sensor assembly, wherein said counter-rotation assembly is adapted to generate in real time mechanical energy in a form of rotation in response to the real time output of the sensor assembly that causes a counter-rotation torque on the device body that opposes the measured angular velocity.

2. The floating device having active stabilization of claim 1, additionally comprising a tether attached to the device body and to a discrete attachment object.

3. The floating device having active stabilization of claim 1, wherein said device body is elongated.

4. The floating device having active stabilization of claim 1, wherein said device body is cylindrical.

5. The floating device having active stabilization of claim 1, wherein said sensor assembly includes at least one of a gyroscope and a compass.

6. The floating device having active stabilization of claim 1, wherein said counter-rotation assembly includes at least a motor operatively connected to a battery, a flywheel operatively connected to the motor, and a controller operative to selectively cause electrical power to be directed from the battery to the motor in a manner which causes the motor to rotate the flywheel.

7. The floating device having active stabilization of claim 6, wherein the controller is connected to the sensor assembly so as to receive as electrical signals output corresponding to a measured angular velocity in real time.

8. A floating device having active stabilization, comprising:

a device body, wherein said device body is buoyant and constructed to be positioned underwater;

a sensor assembly disposed in the device body, wherein the sensor assembly includes a gyroscope, a compass, is adapted to measure angular velocity, and generates a real time output corresponding to a measured angular velocity; and a counter-rotation assembly disposed in the device body integral with said sensor assembly, wherein said counter-rotation assembly includes at least a motor operatively connected to a battery, a flywheel operatively connected to the motor, and a controller operative to selectively cause electrical power to be directed from the battery to the motor in a manner which causes the motor to rotate the flywheel and is adapted to generate in real time mechanical energy in a form of rotation in response to the real time output of the sensor assembly that causes a counter-rotation torque on the device body that opposes the measured angular velocity.

9. The floating device having active stabilization of claim 8, wherein the device body includes a tether that is attached to the device body and to a discrete attachment object.

10. The floating device having active stabilization of claim 8, wherein said device body is elongated.

11. The floating device having active stabilization of claim 8, wherein said device body is cylindrical.

12. The floating device having active stabilization of claim 8, wherein the controller is connected to the sensor assembly so as to receive as electrical signals output corresponding to a measured angular velocity in real time.

13. The floating device having active stabilization of claim 12, additionally comprising a tether attached to the device body and to a discrete attachment object.

14. A method for actively stabilizing a floating device, comprising the steps of:

providing a device body constructed to be buoyant and positioned underwater and having an internal sensor assembly and an internal counter-rotation assembly wherein:

said internal sensor assembly includes at least one of a gyroscope and a compass; and said counter-rotation assembly includes at least a motor operatively connected to a battery, a flywheel operatively connected to the motor, and a controller operative to selectively cause electrical power to be directed from the battery to the motor in a manner which causes the motor to rotate the flywheel;

measuring by the internal sensor assembly an angular velocity of the device body;

determining a desired torque direction and magnitude for the device body to counteract the measured angular velocity of the device body; and causing the counter-rotation assembly to generate in real time mechanical energy in the form of rotation in response to the determined desired torque direction and magnitude that causes a counter-rotation torque on the device body that opposes the measured angular velocity.

15. The method for actively stabilizing a floating device of claim 14, wherein said device body includes a tether attached to the device body and to a discrete attachment object.

16. The method for actively stabilizing a floating device of claim 14, wherein the counter-rotation assembly generates mechanical energy in the form of rotation that causes a counter-rotation torque on the device body that opposes the measured angular velocity using a motor driven flywheel.

17. The method for actively stabilizing a floating device of claim 14, wherein the controller is connected to the sensor assembly so as to receive as electrical signals output corresponding to a measured angular velocity in real time.

* * * * *